US008220469B1

(12) United States Patent
Spagnuolo

(10) Patent No.: US 8,220,469 B1
(45) Date of Patent: Jul. 17, 2012

(54) HAIR HIGHLIGHTING APPLICATOR NOZZLE

(76) Inventor: Rose Spagnuolo, Staten Island, NY (US)

( * ) Notice: Subject to any disclaimer, the term of this patent is extended or adjusted under 35 U.S.C. 154(b) by 0 days.

(21) Appl. No.: 12/928,074

(22) Filed: Dec. 1, 2010

(51) Int. Cl.
*A45D 24/22* (2006.01)
*A45D 24/16* (2006.01)
*A46B 11/00* (2006.01)

(52) U.S. Cl. ..... 132/114; 132/120; 401/28; 401/118

(58) Field of Classification Search ..... 132/112–116, 132/120; 401/28, 118, 140, 268, 286, 287; D28/7, 25; 119/602, 603, 605, 625, 664
See application file for complete search history.

(56) References Cited

U.S. PATENT DOCUMENTS 2,672,875 A * 3/1954 Kovaes ..... 132/112
3,424,176 A 1/1969 Hale
3,523,630 A 8/1970 Catapano
4,592,376 A 6/1986 Sigmund et al.
4,913,172 A * 4/1990 Chou ..... 132/118
4,988,228 A * 1/1991 Yeh ..... 401/289
5,152,305 A 10/1992 Niv
5,499,637 A 3/1996 Foti
6,062,230 A 5/2000 Kajgana
6,691,712 B2 2/2004 Chu et al.
D602,633 S 10/2009 Spagnuolo
7,934,512 B2 5/2011 Spagnuolo
D640,470 S 6/2011 Spagnuolo
2007/0235053 A1* 10/2007 Morgenstern et al. ..... 132/114
2008/0060665 A1* 3/2008 Umeno et al. ..... 132/112

* cited by examiner

*Primary Examiner* — Todd Manahan
*Assistant Examiner* — Niyati D Shah
(74) *Attorney, Agent, or Firm* — Richard L. Miller

(57) ABSTRACT

A hair highlighting applicator nozzle comprises a cap adapted to be removably mounted to an open end of a flexible container for holding a hair coloring fluid therein. A mechanism is for distributing the hair coloring fluid onto the hair. The distributing mechanism is retained to the cap and is in fluid communication with the flexible container. When the flexible container is squeezed the hair coloring fluid will be forced through the distributing mechanism and applied onto the hair.

2 Claims, 9 Drawing Sheets

HAIR HIGHLIGHTING APPLICATOR NOZZLE

BACKGROUND OF THE INVENTION

1. Field of the Invention

The present invention relates to hair coloring apparatus, and more particularly, a hair highlighting applicator nozzle.

2. Description of the Prior Art

Numerous innovations for hair dye applicator brushes have been provided in the prior art that will be described. Even though these innovations may be suitable for the specific individual purposes to which they address, however, they differ from the present invention.

A FIRST EXAMPLE, U.S. Pat. No. 3,424,176, Issued on Jan. 28, 1969, to Hale teaches a hair dyeing apparatus and in particular, to wet combs and brushes for applying developers, dyes, tints, bleaches, wave-set solutions and the like to the hair.

A SECOND EXAMPLE, U.S. Pat. No. 3,523,630, Issued on Aug. 11, 1970, to Catapano teaches a liquid dispensing device comprising a liquid container, and an applicator including a cap section attached to the liquid container and a pair of elongated nozzle sections mounted on the cap section and projecting outwardly therefrom.

A THIRD EXAMPLE, U.S. Pat. No. 4,592,376, Issued on Jun. 3, 1986, to Sigmund et al. teaches a hair dye applicating apparatus that has a handle part formed as a hair dye supply container, a combination part connected with the supply container, a hair separating tip arranged on the combination part in spaced relationship with the supply container, a comb member having a plurality of tines and arranged on the combination part adjacent the supply container, a hair dye application part including a displaceable brush member having a plurality of bristle bundles, and an elastic nozzle member located inside the brush member so as to be surrounded by the bristle bundles and to form a hair dye outlet opening.

A FOURTH EXAMPLE, U.S. Pat. No. 5,152,305, Issued on Oct. 6, 1992, to Niv teaches an apparatus for a hair dye applicator which includes a hollow tubular housing with screw-threadably removable caps on both longitudinal ends thereof. One of the caps includes a centrally located outlet through which a hollow stem of an integrally formed nozzle unit is fitted. A manually actuable piston is provided within the tubular housing and includes an actuator member longitudinally slidable along the length of and external to the tubular housing. To ensure that the piston does not axially rotate within the tubular housing during a longitudinal sliding motion thereof, a protruding track is longitudinally provided on the inner wall of the tubular housing and mates with a corresponding recess of the piston. A liner such as a disposable plastic bag is provided within the tubular housing above the piston for receiving a hair dispensable product therein. The screw-threaded end caps confine the contents of the applicator during use thereof.

A FIFTH EXAMPLE, U.S. Pat. No. 5,499,637, Issued on Mar. 19, 1996, to Foti teaches an improved applicator brush which provides a tapered handle portion for lifting and separating hair, and a plurality of bristles emanating perpendicularly therefrom. In one embodiment, the brush is formed by connecting a conventional applicator brush through a bore in a tapered handle in order to form the perpendicular connection.

A SIXTH EXAMPLE, U.S. Pat. No. 6,062,230, Issued on May 16, 2000, to Kajgana teaches a tint brush with a color distributor having an anatomically designed container which has an elliptical shape and is screwed onto a connection pipe with a main tinter body. The container and connection pipe are inclined relative to a vertical axis of the main tinter body, preferably, by 60 degrees. A free flow of hair dye mixture from the container is enabled by squeezing the container or by using a pump provided in the container in an alternative embodiment. A collector area defined in the main tinter body collects dye mixture wherefrom the dye mixture is distributed with the aid of a flow regulator and a plurality of radial exit bores which define, on their ends, funnel-like or shaped openings that open in tangent with a set of bristles connected to the tinter body. The flow regulator is suitably grooved so that the rate of dye mixture flowing through the main tinter body can be regulated from a minimum to a maximum amount by turning the flow regulator by 90 degrees. The flow regulator body is sealed to the main tinter body using a set of O-rings and the grooves defined in the regulator body are formed adjacent the plurality of radial exit bores so that the dye mixture flow can be controlled.

A SEVENTH EXAMPLE, U.S. Pat. No. 6,691,712, Issued on Feb. 17, 2004, to Chu et al. teaches a dispensing device for use as a hair dye applicator having a manifold having a first end configured to receive liquid dye and an inside surface and an outside surface. The manifold has a conduit communicating with the inside surface and the first end which provides fluid communication between the first end and at least one orifice extending from the inside surface to the outside surface. The manifold further includes a first lip and a second lip on the outside surface with the first lip surrounding the orifice and the second lip surrounding the first lip. The manifold further includes a flexible fluid dispensing member having an inside surface and an outside surface and a plurality of apertures passing from the inside surface to the outside surface that presents the dye to the hair, the inside surface of the member contacting the outside surface of the manifold including the first and second lips such that a resilient seal is formed until the dye is forced through the orifices when the member allows the dye to pass over the first lip and through the plurality of apertures.

AN EIGHTH EXAMPLE, U.S. Pat. No. D602,633, Issued on Oct. 20, 2009, to Spagnuolo teaches an ornamental design for a hair color applicator as shown, and described.

It is apparent now that numerous innovations for hair dye applicator brushes have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a hair highlighting applicator nozzle that avoids the disadvantages of the prior art.

ANOTHER OBJECT of the present invention is to provide a hair highlighting applicator nozzle that is simple and inexpensive to manufacture.

STILL ANOTHER OBJECT of the present invention is to provide a hair highlighting applicator nozzle that is simple to use.

BRIEFLY STATED, STILL YET ANOTHER OBJECT of the present invention is to provide a hair highlighting applicator nozzle which comprises a cap removably mounted to an open end of a flexible container holding a hair coloring fluid therein. A mechanism is for distributing the hair coloring fluid onto the hair. The distributing mechanism is retained to the cap and is in fluid communication with the flexible container. When the flexible container is squeezed the hair coloring fluid will be forced through the distributing mechanism and applied onto the hair.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

First Embodiment

Figure 1:
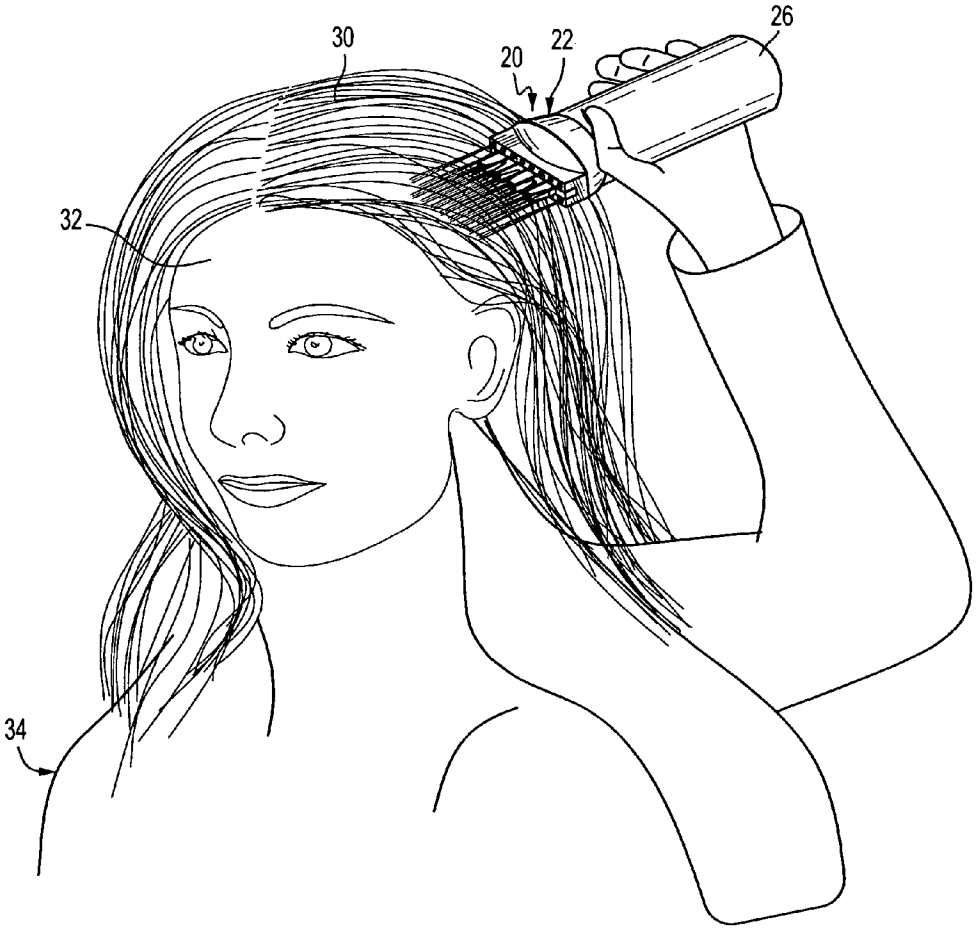
FIG. 1 is a diagrammatic perspective view showing a first embodiment of the present invention in use.

20 hair highlighting applicator nozzle
22 cap of applicator nozzle 20
24 open end of flexible container 26
26 flexible container
28 distributing mechanism of applicator nozzle 20
30 hair on head 32
32 head of person 34
34 person
36 curved cover of cap 22
38 raised block portion on curved cover 36
40 slotted recess in raised block portion 38
42 central elongated aperture in slotted recess 40
44 annular tapered collar of cap 22
46 internal threads in annular tapered collar 44
48 external threads on open end 24
50 nozzle assembly of distributing mechanism 28
52 hollow bar of distributing mechanism 28
54 hollow truncated pyramidal tip of nozzle assembly 50
56 partition of nozzle assembly 50
57 bristle cluster of applicator nozzle 20
58 rectangular shaped configuration for slotted recess 40
60 rectangular shaped configuration for hollow bar 52

Second Embodiment

120 hair highlighting applicator nozzle
122 cap of applicator nozzle 120
128 distributing mechanism of applicator nozzle 120
136 curved cover of cap 122
138 raised block portion on curved cover 136
140 slotted recess in raised block portion 138
144 annular tapered collar of cap 122
150 nozzle assembly of distributing mechanism 128
152 hollow bar of distributing mechanism 128
154 hollow truncated pyramidal tip of nozzle assembly 150
158 trapezoidal groove shaped configuration for slotted recess 140
160 trapezoidal tongue shaped configuration for hollow bar 152

DETAILED DESCRIPTION OF THE PREFERRED EMBODIMENT

Figure 2:
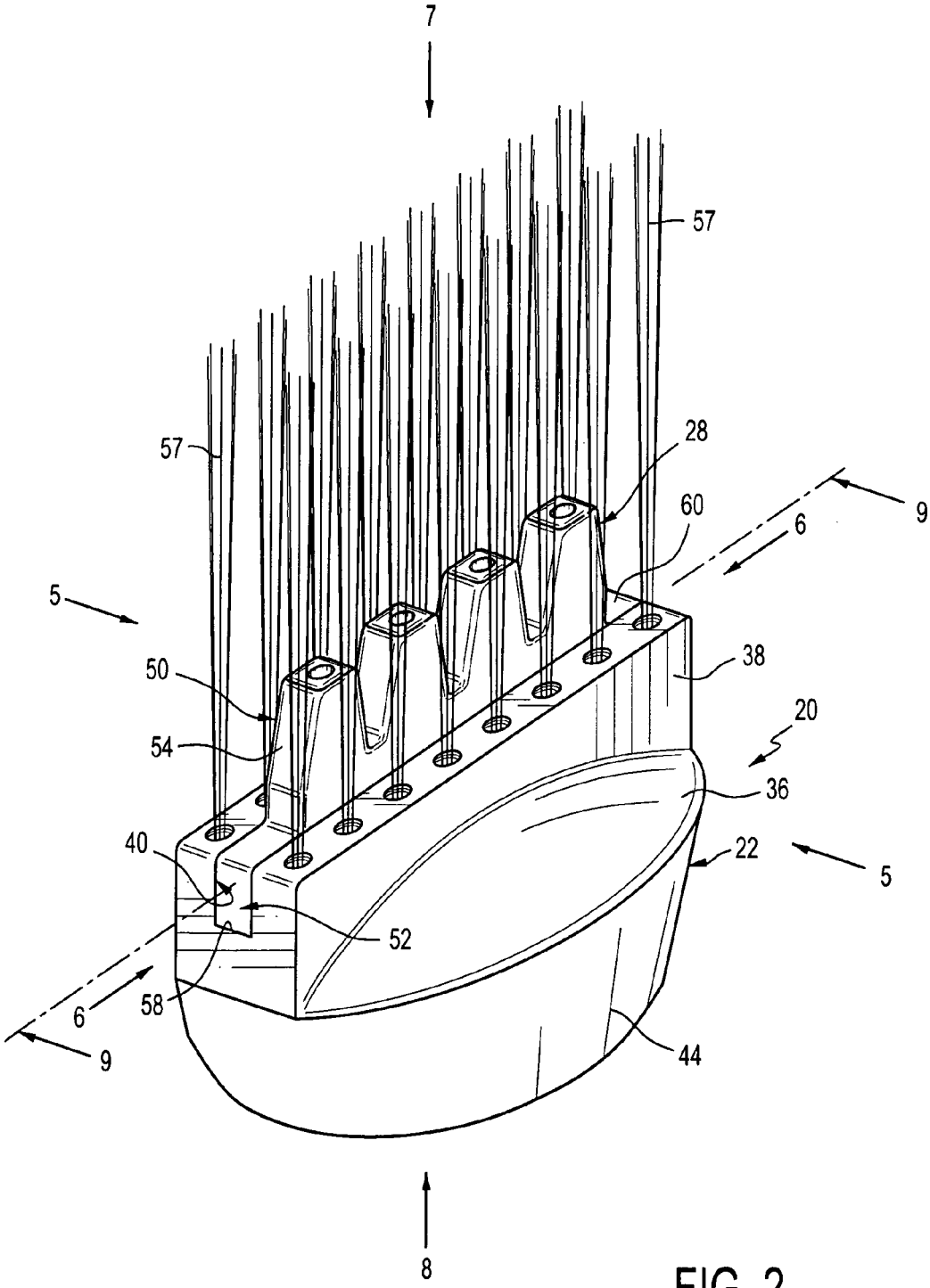
FIG. 2 is an enlarged diagrammatic perspective view of the first embodiment per se.
Figure 3:
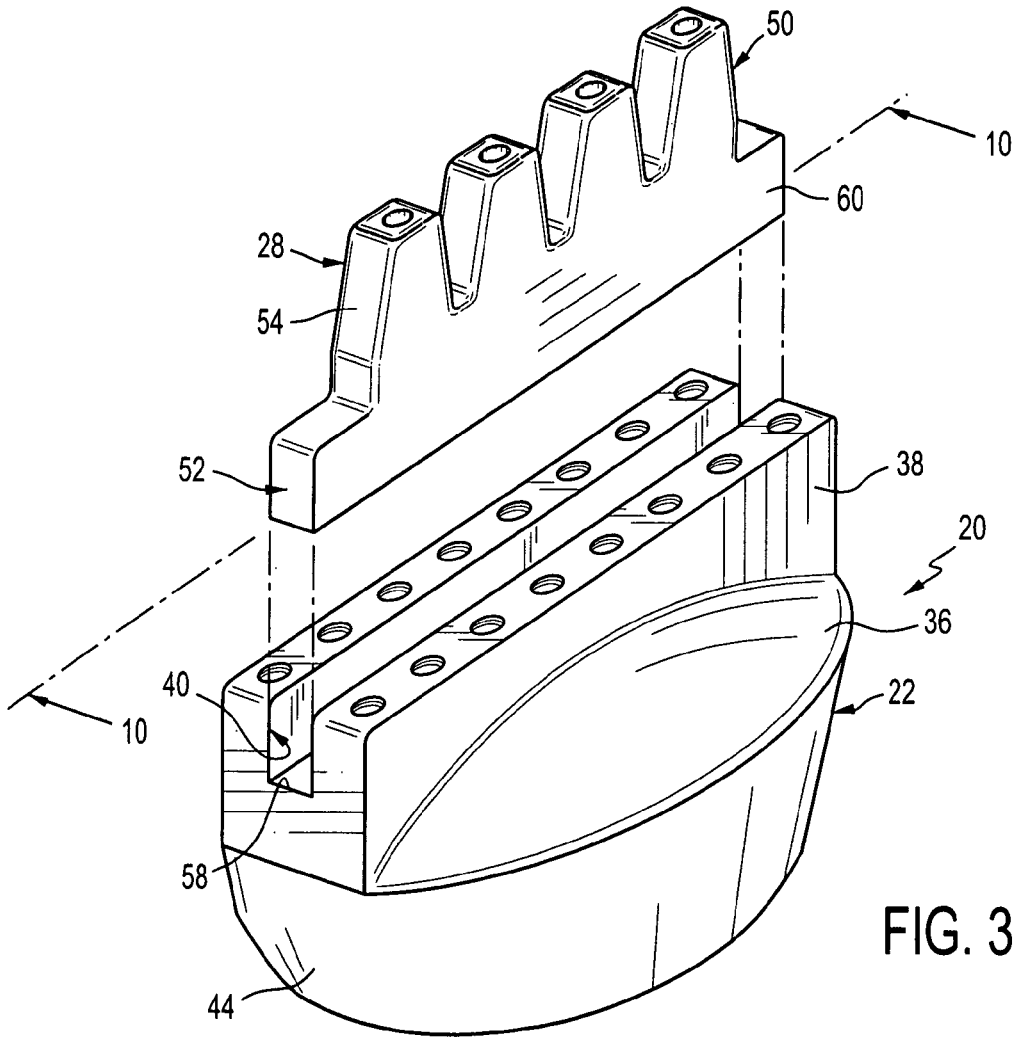
FIG. 3 is an exploded diagrammatic perspective view of the first embodiment per se, with parts removed therefrom.
Figure 4:
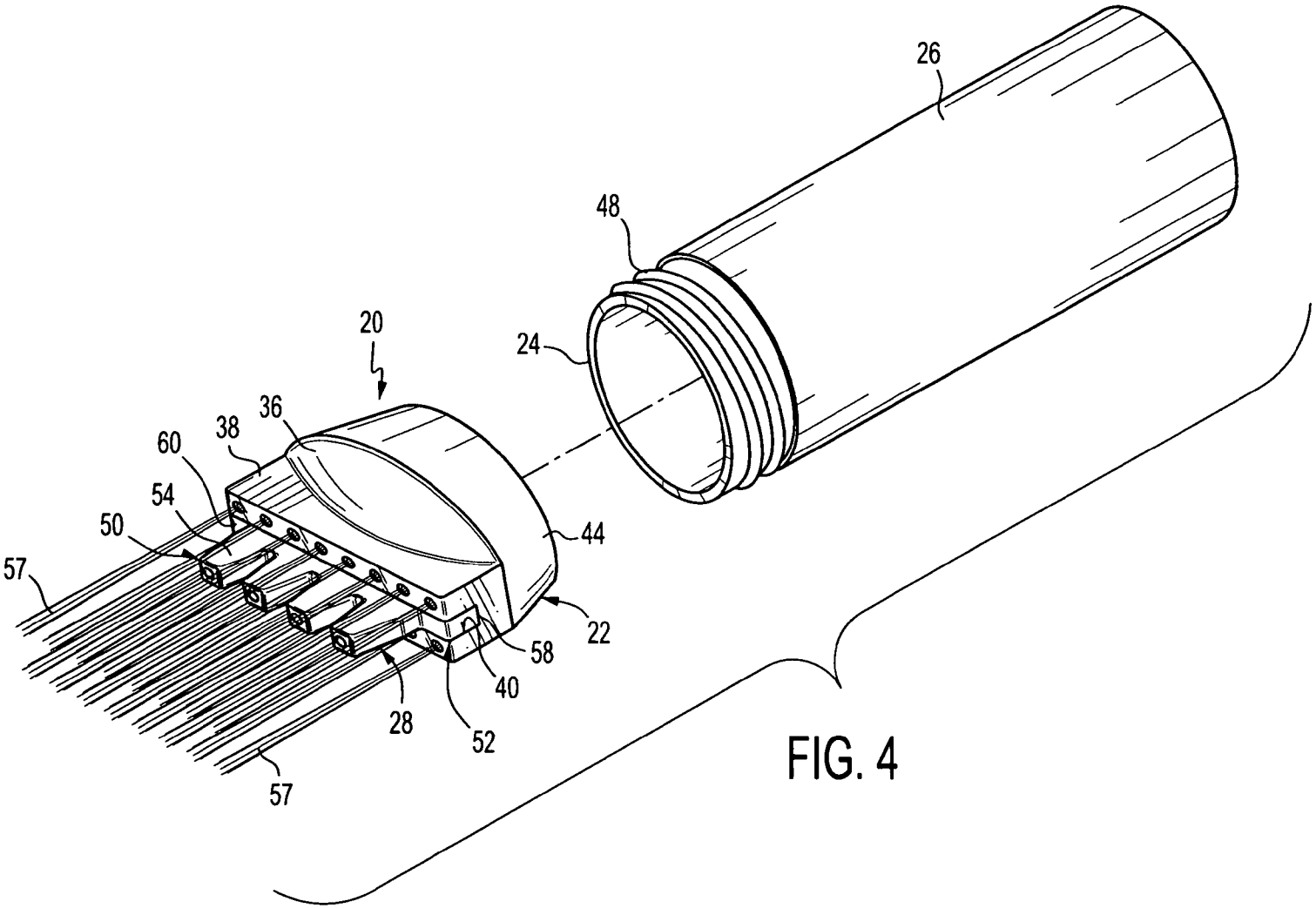
FIG. 4 is a diagrammatic perspective view of the first embodiment separated from the prior art flexible container.
Figure 5:
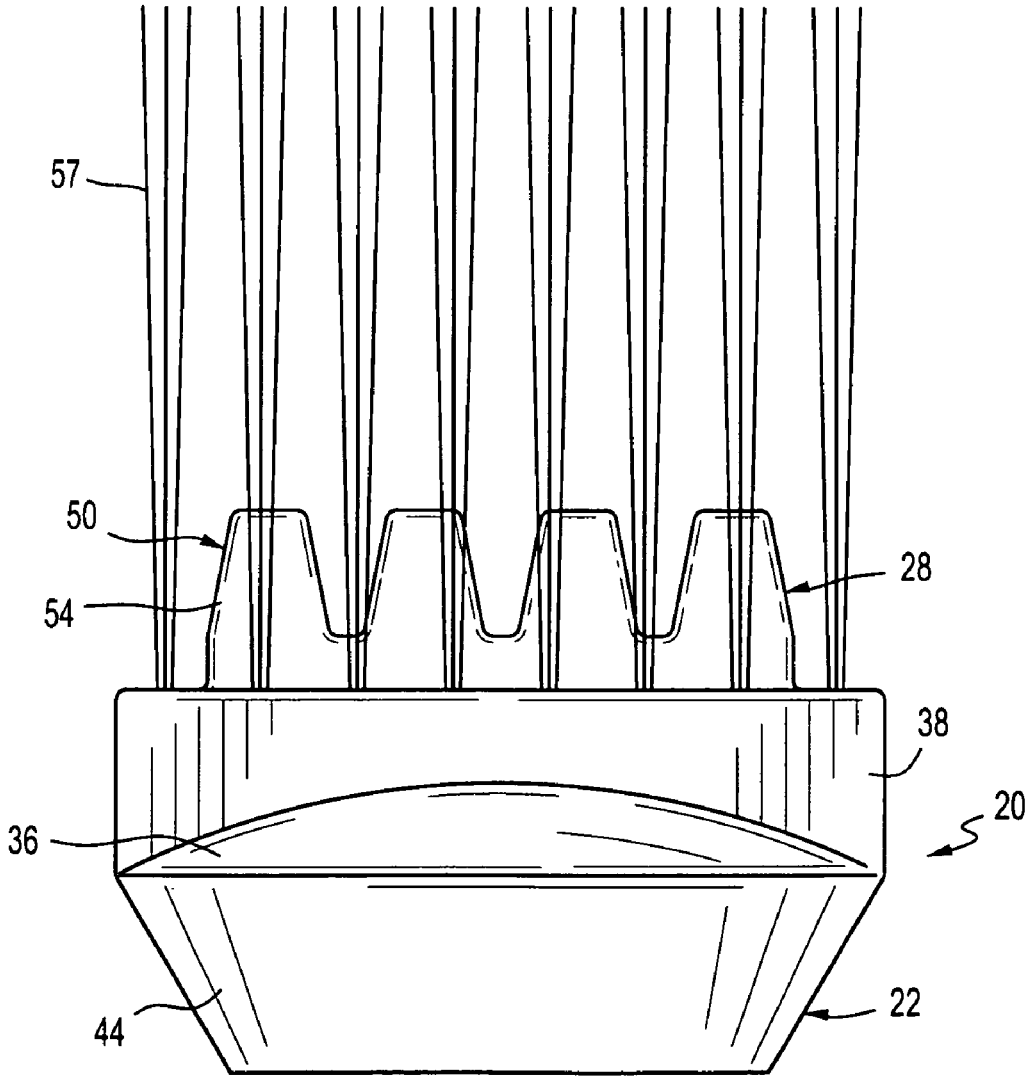
FIG. 5 is a diagrammatic elevational view taken in the direction of arrows 5 in FIG. 2.
Figure 6:
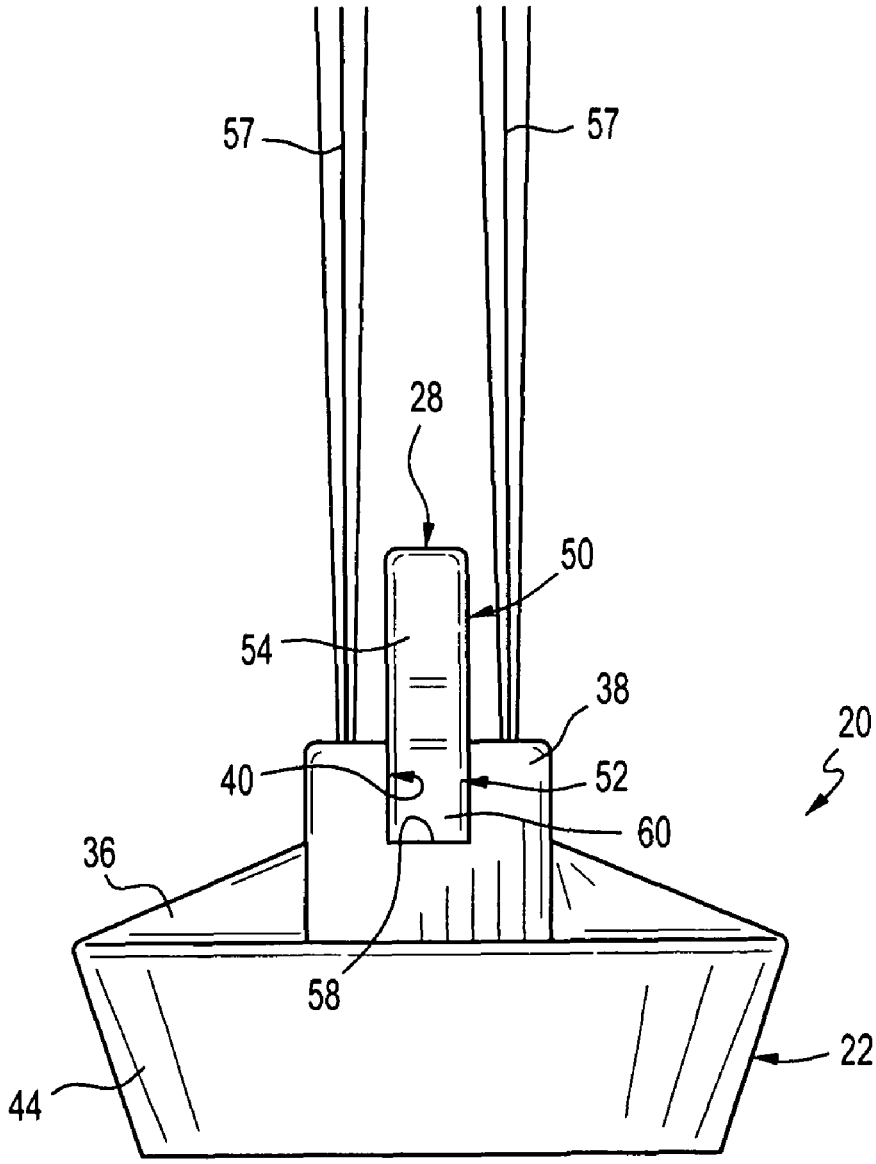
FIG. 6 is a diagrammatic elevational view taken in the direction of arrow 6 in FIG. 2.
Figure 7:
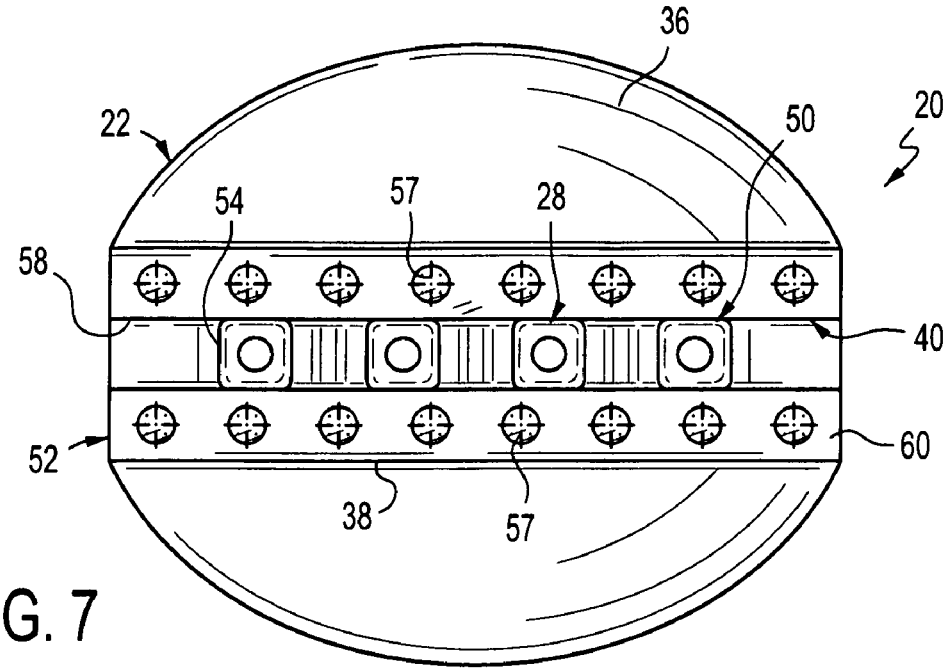
FIG. 7 is a diagrammatic top view taken in the direction of arrow 7 in FIG. 2.
Figure 8:
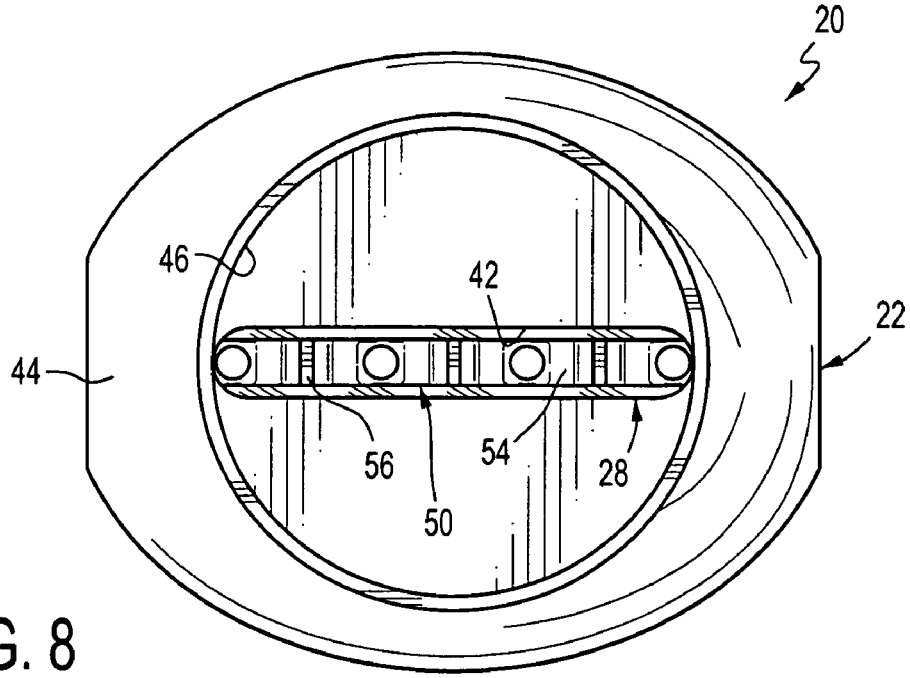
FIG. 8 is a diagrammatic bottom view taken in the direction of arrow 8 in FIG. 2.
Figure 9:
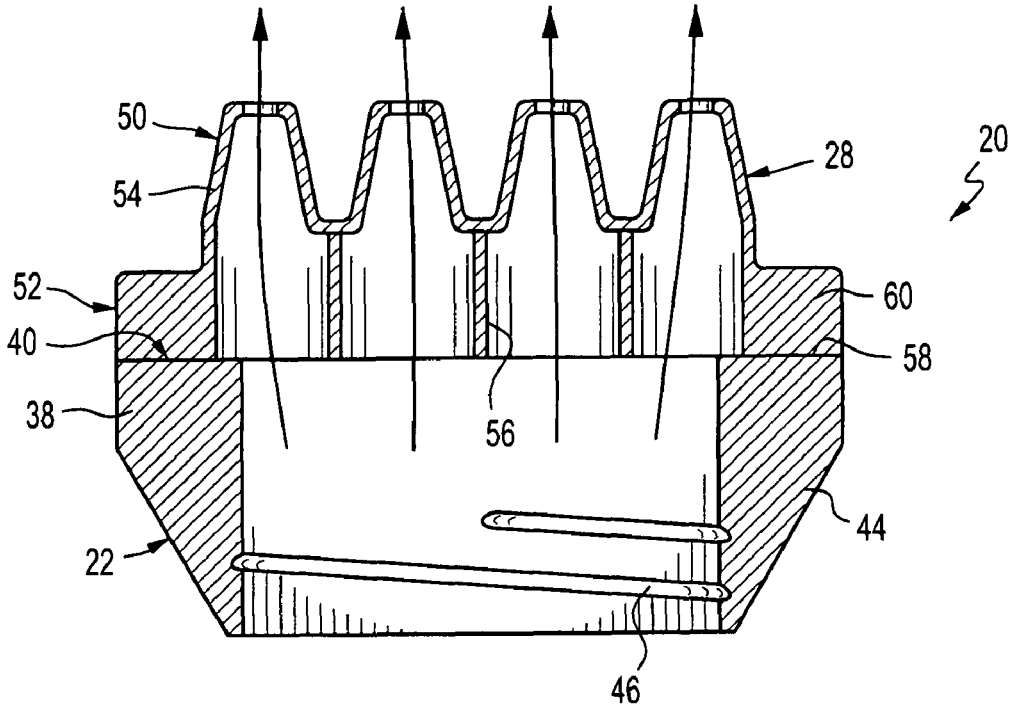
FIG. 9 is a diagrammatic cross sectional view taken on line 9-9 in FIG. 2.
Figure 10:
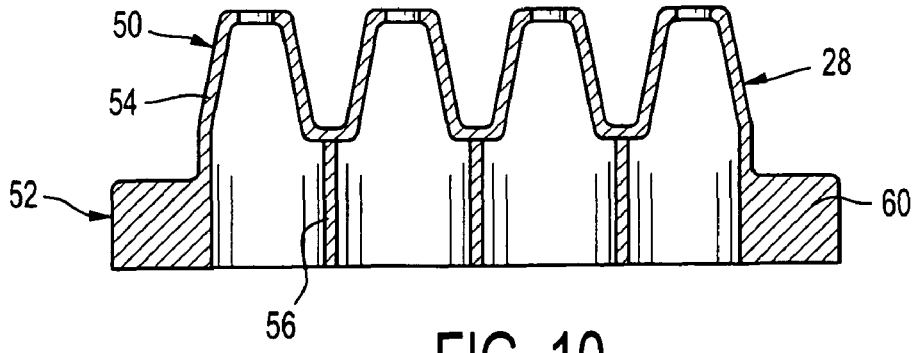
FIG. 10 is a diagrammatic cross sectional view taken on line 10-10 in FIG. 3 of just the nozzle assembly.

Referring now to the figures, in which like numerals indicate like parts, and particularly to FIGS. 1 through 10, which are a diagrammatic perspective view showing a first embodiment of the present invention in use; an enlarged diagrammatic perspective view of the first embodiment per se; an exploded diagrammatic perspective view of the first embodiment per se, with parts removed therefrom; a diagrammatic perspective view of the first embodiment separated from the prior art flexible container; a diagrammatic elevational view taken in the direction of arrows 5 in FIG. 2; a diagrammatic elevational view taken in the direction of arrow 6 in FIG. 2; a diagrammatic top view taken in the direction of arrow 7 in FIG. 2; a diagrammatic bottom view taken in the direction of arrow 8 in FIG. 2; a diagrammatic cross sectional view taken on line 9-9 in FIG. 2; and a diagrammatic cross sectional view taken on line 10-10 in FIG. 3 of just the nozzle assembly, and as such, will be discussed with reference thereto.

The first embodiment of the present invention is a hair highlighting applicator nozzle 20 that comprises a cap 22 removably mounted to an open end 24 of a flexible container 26 holding a hair coloring fluid therein. A mechanism 28 is for distributing the hair coloring fluid onto the hair 30. The distributing mechanism 28 is retained to the cap 22 and is in fluid communication with the flexible container 26. When the flexible container 26 is squeezed the hair coloring fluid will be forced through the distributing mechanism 28 and applied onto the hair 30 on the head 32 of a person 34.

The cap 22 comprises a curved cover 36 with a raised block portion 38 having a slotted recess 40 thereacross with a central elongated aperture 42 therein and an annular tapered collar 44 having internal threads 46 to engage with external threads 48 on the open end of the flexible container 26. The distributing mechanism 28 comprises a nozzle assembly 50 having a hollow bar 52 that is retained within the slotted recess 40 in the raised block portion 38 on the curved cover 36 of the cap 22.

The nozzle assembly 50 comprises a plurality of hollow truncated pyramidal tips 54 extending from the hollow bar 52. A plurality of partitions 56 within the hollow bar 52 extend between the hollow truncated pyramidal tips 54 to allow the hair coloring fluid to exit in a parallel relationship into the hair 30.

The applicator nozzle 20 further comprises a plurality of bristle clusters 57 extending in two rows from the raised block portion 38 on the curved cover 36 of the cap 22 at opposite sides of the nozzle assembly 50 to help brush the hair coloring fluid into the hair 30.

As best seen in FIG. 3, the slotted recess 40 in the raised block portion 38 on the curved cover 36 of the cap 22 is in a rectangular shaped configuration 58. The hollow bar 52 of the nozzle assembly 50 is in a rectangular shaped configuration 60 and is of a size to snugly fit into the slotted recess 40 in the raised block portion 58 on the curved cover 36 of the cap 22.

Figure 11:
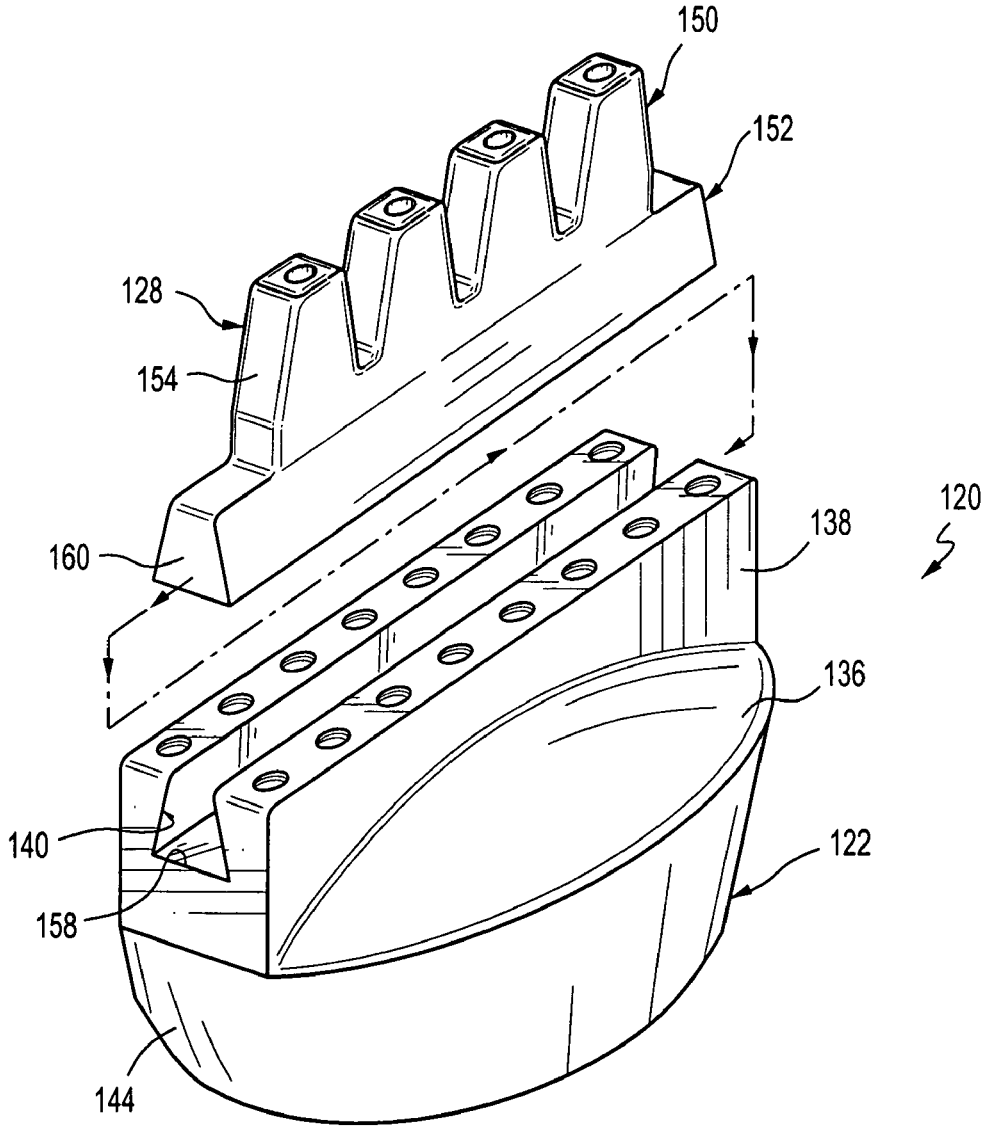
FIG. 11 is an exploded diagrammatic perspective view of a second embodiment of the present invention, with parts removed therefrom.

FIG. 11 is an exploded diagrammatic perspective view of a second embodiment of the present invention, with parts removed therefrom, and as such, will be discussed with reference thereto.

The second embodiment is an applicator nozzle 120 that is similar to the applicator nozzle 20, but the slotted recess 140 in the raised block portion 138 on the curved cover 136 of the cap 122 is in a trapezoidal groove shaped configuration 158. The hollow bar 152 of the nozzle assembly 150 is in a trapezoidal tongue shaped configuration 160 and is of a size to snugly slide into the slotted recess 140 in the raised block portion 138 of the curved cover 136 of the cap 122.

It will be understood that each of the elements described above, or two or more together, may also find a useful application in other types of constructions differing from the types described above.

While the invention has been illustrated and described as embodiments of a hair highlighting applicator nozzle, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hair highlighting applicator comprising:

a) a flexible container having an open end and being for holding a hair coloring fluid therein;

b) a cap removably mounted to said open end of said flexible container;

c) means for distributing the hair coloring fluid onto hair;

wherein said distributing means is retained to said cap and is in fluid communication with said flexible container;

wherein when said flexible container is squeezed, the hair coloring fluid is forced through said distributing means and is capable of being applied onto the hair;

wherein said open end of said flexible container has a thread portion thereon; wherein said cap comprises a curved base with a raised block portion having a slotted recess there across with a central elongated aperture therein and an annular tapered collar having a thread portion engaging with said thread portion on said open end of said flexible container;

wherein said distributing means comprises a nozzle assembly having a hollow bar that is retained within said slotted recess in said raised block portion on said curved base of said cap;

d) a plurality of bristle clusters extending in two rows from said raised block portion on said curved base of said cap at opposite sides of said nozzle assembly for helping to brush the hair coloring fluid into the hair;

wherein said nozzle assembly comprises:

i) a plurality of hollow truncated pyramidal tips extending from said hollow bar; and ii) a plurality of partitions within said hollow bar extending between said hollow truncated pyramidal tips for allowing the hair coloring fluid to exit in a parallel relationship into the hair;

wherein said slotted recess in said raised block portion on said curved base of said cap is in a rectangular shaped configuration; and wherein said hollow bar of said nozzle assembly is in a rectangular shaped configuration and is of a size to snugly fit into said slotted recess in said raised block portion on said curved base of said cap.

2. A hair highlighting applicator, comprising:

a) a flexible container having an open end and being for holding a hair coloring fluid therein;

b) a cap removably mounted to said open end of said flexible container;

c) means for distributing the hair coloring fluid onto hair;

wherein said distributing means is retained to said cap and is in fluid communication with said flexible container;

wherein when said flexible container is squeezed, the hair coloring fluid is forced through said distributing means and is capable of being applied onto the hair;

wherein said open end of said flexible container has a thread portion thereon;

wherein said cap comprises a curved base with a raised block portion having a slotted recess there across with a central elongated aperture therein and an annular tapered collar having a thread portion engaging with said thread portion on said open end of said flexible container;

wherein said distributing means comprises a nozzle assembly having a hollow bar that is retained within said slotted recess in said raised block portion on said curved base of said cap;

d) a plurality of bristle clusters extending in two rows from said raised block portion on said curved base of said cap at opposite sides of said nozzle assembly for helping to brush the hair coloring fluid into the hair;

wherein said nozzle assembly comprises:

i) a plurality of hollow truncated pyramidal tips extending from said hollow bar; and ii) a plurality of partitions within said hollow bar extending between said hollow truncated pyramidal tips for allowing the hair coloring fluid to exit in a parallel relationship into the hair;

wherein said slotted recess in said raised block portion on said curved base of said cap is in a trapezoidal groove shaped configuration; and wherein said hollow bar of said nozzle assembly is in a trapezoidal tongue shaped configuration and is of a size to snugly slide into said slotted recess in said raised block portion of said curved base of said cap.

* * * * *